US007686140B2

(12) United States Patent
Rossignol et al.

(10) Patent No.: US 7,686,140 B2
(45) Date of Patent: Mar. 30, 2010

(54) ELEVATOR SUPPORT MEANS MONITORING DEVICE AND A METHOD

(75) Inventors: Eric Rossignol, Dietwil (CH); Sven Winter, Burgstetten (DE)

(73) Assignee: Inventio AG, Hergiswil NW (CH)

( * ) Notice: Subject to any disclaimer, the term of this patent is extended or adjusted under 35 U.S.C. 154(b) by 456 days.

(21) Appl. No.: 11/736,829

(22) Filed: Apr. 18, 2007

(65) Prior Publication Data

US 2008/0202863 A1 Aug. 28, 2008

(30) Foreign Application Priority Data

Apr. 18, 2006 (EP) ..... 06112728

(51) Int. Cl.
*B66B 1/34* (2006.01)

(52) U.S. Cl. ..... 187/393; 73/158

(58) Field of Classification Search ..... 187/247, 187/391–394; 73/597, 602, 598, 643, 620, 73/632, 158; 324/535, 539, 542, 206, 207.13, 324/207.17

See application file for complete search history.

(56) References Cited

U.S. PATENT DOCUMENTS

| | | | | |
|---|---|---|---|---|
| 4,427,940 | A * | 1/1984 | Hirama et al. | 324/240 |
| 4,827,215 | A * | 5/1989 | van der Walt | 324/227 |
| 6,923,065 | B2 * | 8/2005 | Smith et al. | 73/597 |
| 2005/0063449 | A1 | 3/2005 | Lustenberger | |

FOREIGN PATENT DOCUMENTS

| | | | |
|---|---|---|---|
| JP | 2004149317 | A | 5/2004 |

* cited by examiner

*Primary Examiner*—Jonathan Salata
(74) *Attorney, Agent, or Firm*—Fraser Clemens Martin & Miller LLC; William J. Clemens

(57) ABSTRACT

An elevator installation includes a device for monitoring the state of support belts. An elevator car and a counterweight are connected by the support belts and are movable in a vertical shaft in opposite sense along guide tracks. The monitoring device is fastened to the guide track by a support and has a guide device, preferably a guide roller, which guides the support belt along a scanning surface the monitoring device. The scanning surface and the support belt are protected simply and effectively against damage.

14 Claims, 8 Drawing Sheets

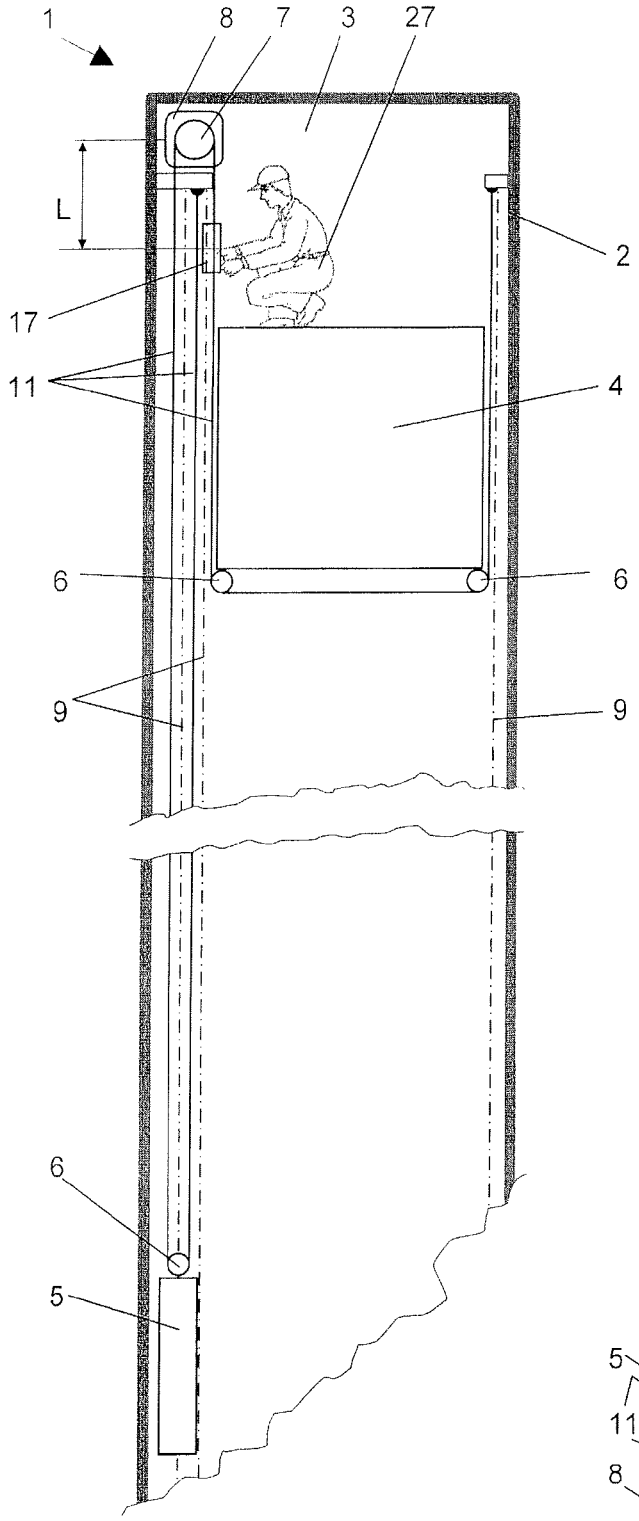
Fig. 3
Fig. 3a
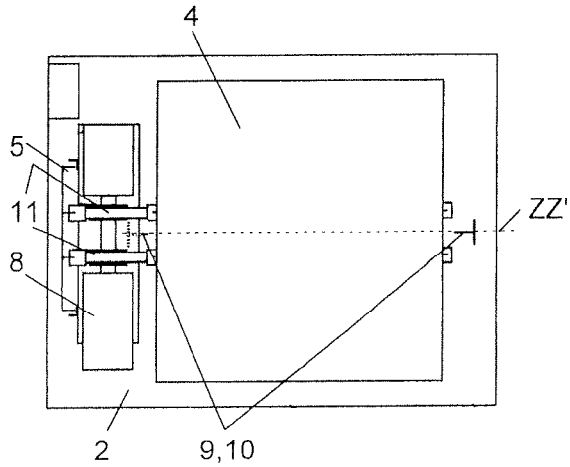

ELEVATOR SUPPORT MEANS MONITORING DEVICE AND A METHOD

FIELD OF THE INVENTION

The invention relates to a elevator installation with a support means monitoring device for monitoring the state of a support means and to a method for checking the support means.

BACKGROUND OF THE INVENTION

The elevator installation is installed in a substantially vertical shaft. It essentially consists of a car and a counterweight which are arranged to be movable in the shaft in opposite sense along guide rails. The car and the counterweight are connected together and supported by means of a support means. A state of the support means is monitored by means of a support means monitoring unit.

A support cable monitoring unit for ascertaining the state of a support cable of an elevator installation is known from patent document JP 2004149317, which unit is arranged in the engine room in the vicinity of a drive engine or also at a guide rail in the vicinity of the drive engine of this elevator installation. In this case a mounting enables fastening of the support cable monitoring unit to a drive engine foundation or to a guide rail. The mounting relieves a user from holding the support cable monitoring unit. The arrangement in the vicinity of the drive engine has the obvious advantage that—during travel over a height of the shaft—principally loaded sections of the support means are detected. The support cable monitoring unit can be connected with an evaluating unit.

A disadvantage of this arrangement is that on the one hand the support cables, which are moved along the support cable monitoring unit, can damage or scratch scanning surfaces of the support cable monitoring unit or that edges of the support cable monitoring unit damage a support cable. Moreover, present-day elevators are increasingly provided with belt-like support means instead of support cables. In this case the support cable is no longer recognizable as a single support cable, but is disposed in a casing enclosing several cables. Such belt-like support means are particularly sensitive, since the surrounding casing consists of rubber or plastic material.

SUMMARY OF THE INVENTION

The present invention now has an object of constructing a support means monitoring unit in such a manner that damage of the support means as well as of the support means monitoring unit is precluded. In addition, a method for rational performance of the support means check shall be indicated.

In this case use is made in an elevator installation with an elevator car and a counterweight, which are connected together by a support means and which are movable in a vertical shaft in opposite sense along guide rails, of a support means monitoring device for monitoring the state of the support means. The support means monitoring device is fastened to the guide rail by means of a support. According to the present invention the support means monitoring device comprises a guide device, preferably a guide roller, which guides the support means along a scanning surface of the support means monitoring device. The support means is in this connection a belt-like support means. The advantage of the present invention results from the fact that the support means can be guided precisely and gently in the support means monitoring device and that possible diagonal tensions or twists in the support means do not lead to excessive loading of the support means or to excessive loading of the scanning surface. Damage of support means and scanning surface is thereby prevented.

Thus, the scanning surface along which the belt-like support means is guided is advantageously provided with an exchangeable protective coating protecting the scanning surface against damage. This is advantageous, since the protective coating protects on the one hand the support means monitoring unit itself and on the other hand the support means against damage and this protective coating can, by virtue of its exchangeability, be renewed simply and quickly. Moreover, the support means monitoring unit can thereby be used particularly satisfactorily for belts, which are additionally protected by the protective layer against damage.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 3 is a schematic view of an elevator installation with a support means monitoring unit arranged in accordance with the present invention;

FIG. 3*a* is a cross-section through the elevator installation of FIG. 3 by way of example;

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
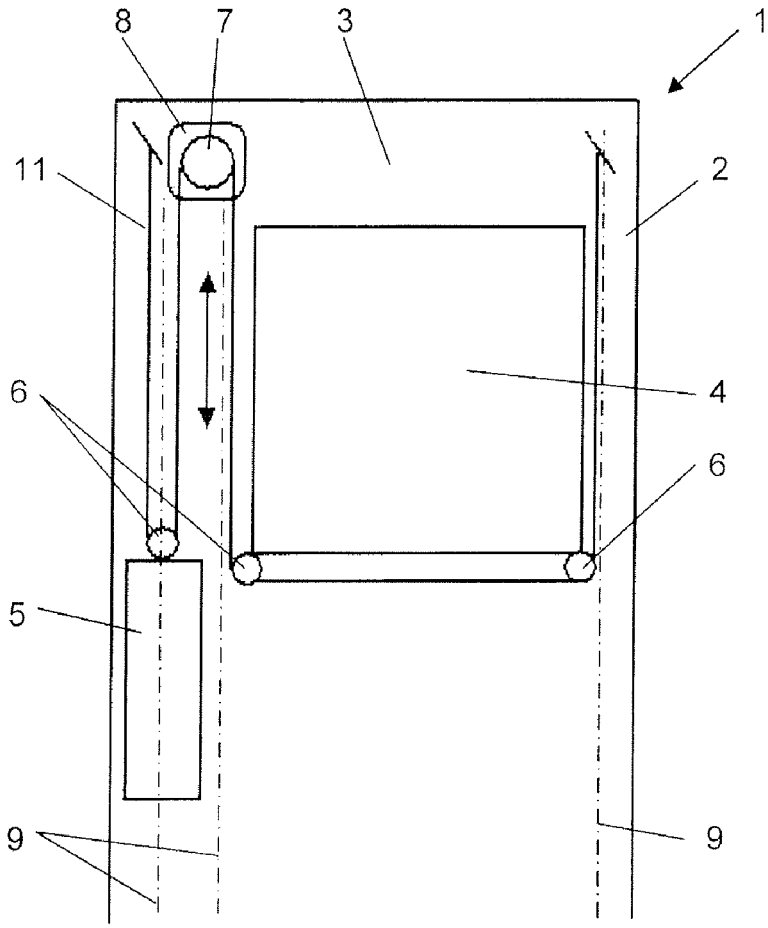
FIG. 1 is a schematic view of an elevator installation.

An elevator installation 1 substantially serves for vertical transportation of persons or goods. The elevator installation 1 consists, as illustrated in FIG. 1, of an elevator car 4 and a counterweight 5, which in the illustrated example are connected by way of support rollers 6 with a support means 11 and with one another and which are movable in a shaft 2 in opposite sense along guide tracks 9. A drive device 8 usually drives the support means 11 by means of a drive pulley 7 by friction couple. The drive device 8 is frequently arranged in the shaft head 3, i.e. in the space above the elevator car 4 and the counterweight 5, either in a separate engine room or within the shaft space.

The drive device 8 can also be arranged in lateral spaces or laterally of the car 4 or below the car 4 and the counterweight 5. In these cases deflecting rollers which deflect the support means 11 in correspondence with selected cable guides are often disposed in the space above car 4 and the counterweight 5.

Figure 2:
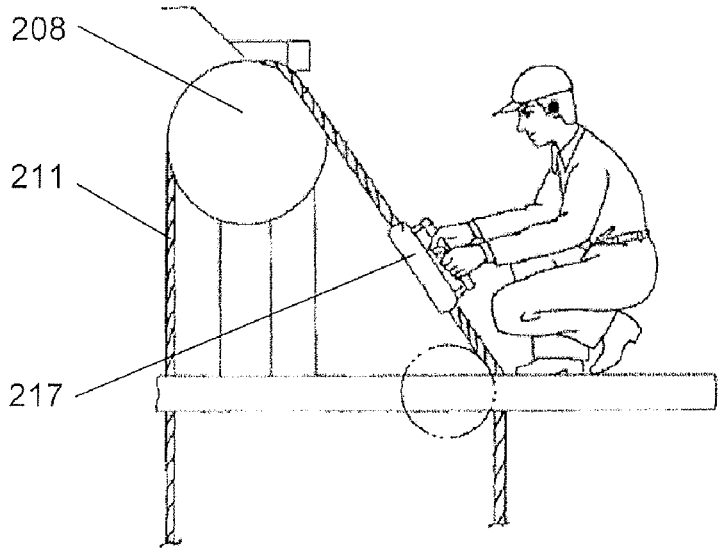
Fig. 2 (prior art)
FIG. 2 is a schematic view of the arrangement of a support means monitoring unit in correspondence with the state of the art.

The support means 11 is subject to wear and aging. Wear and aging arise through friction between drive pulley 7 and the support means 11 or through repeated bending of the support means 11 when deflected over deflecting rollers, the support rollers 6 and the drive pulley 7 as well as, for example, due to corrosion processes. This wear or aging leads to a constant reduction in the tolerable load-bearing force of the support means 11. Accordingly, the support means 11 in operation has to be checked constantly or at periodic intervals in time. Checks of that kind are more frequently carried out by means of electromagnetic measuring means. In this connection wear or fracture is recognized on the basis of disturbances in a magnetic field due to different steel concentrations in the support means cross-section. FIG. 2 shows performance of a support means check in accordance with the known state of the art. A support means monitoring device 217 is held or fixed in the vicinity of the drive device 208 and the support means 211 are slowly moved along the support means monitoring device 217 by means of the drive device 208.

Figure 6:
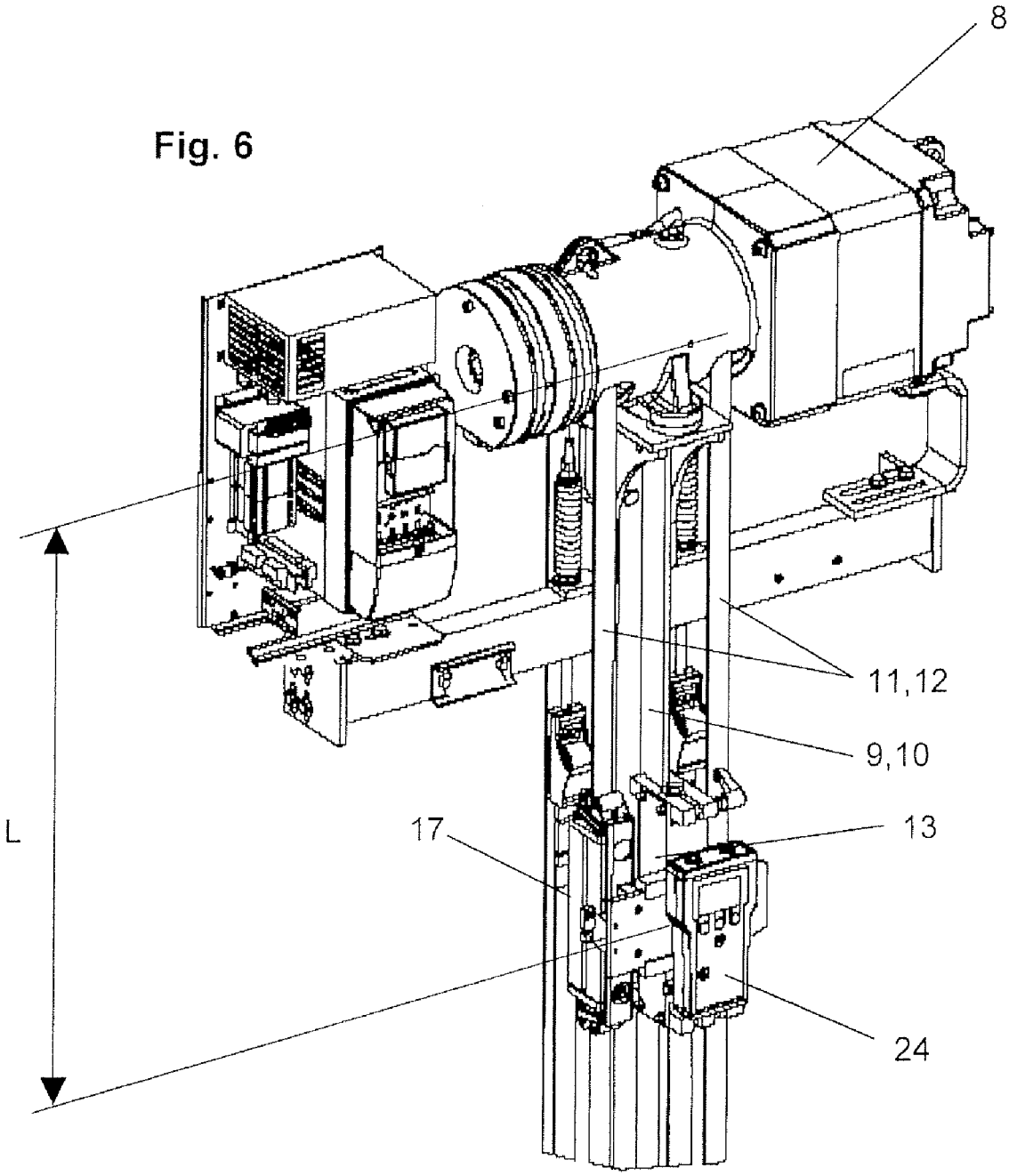
FIG. 6 is a perspective view of an attached support means monitoring unit in accordance with the present invention.
Figure 7:
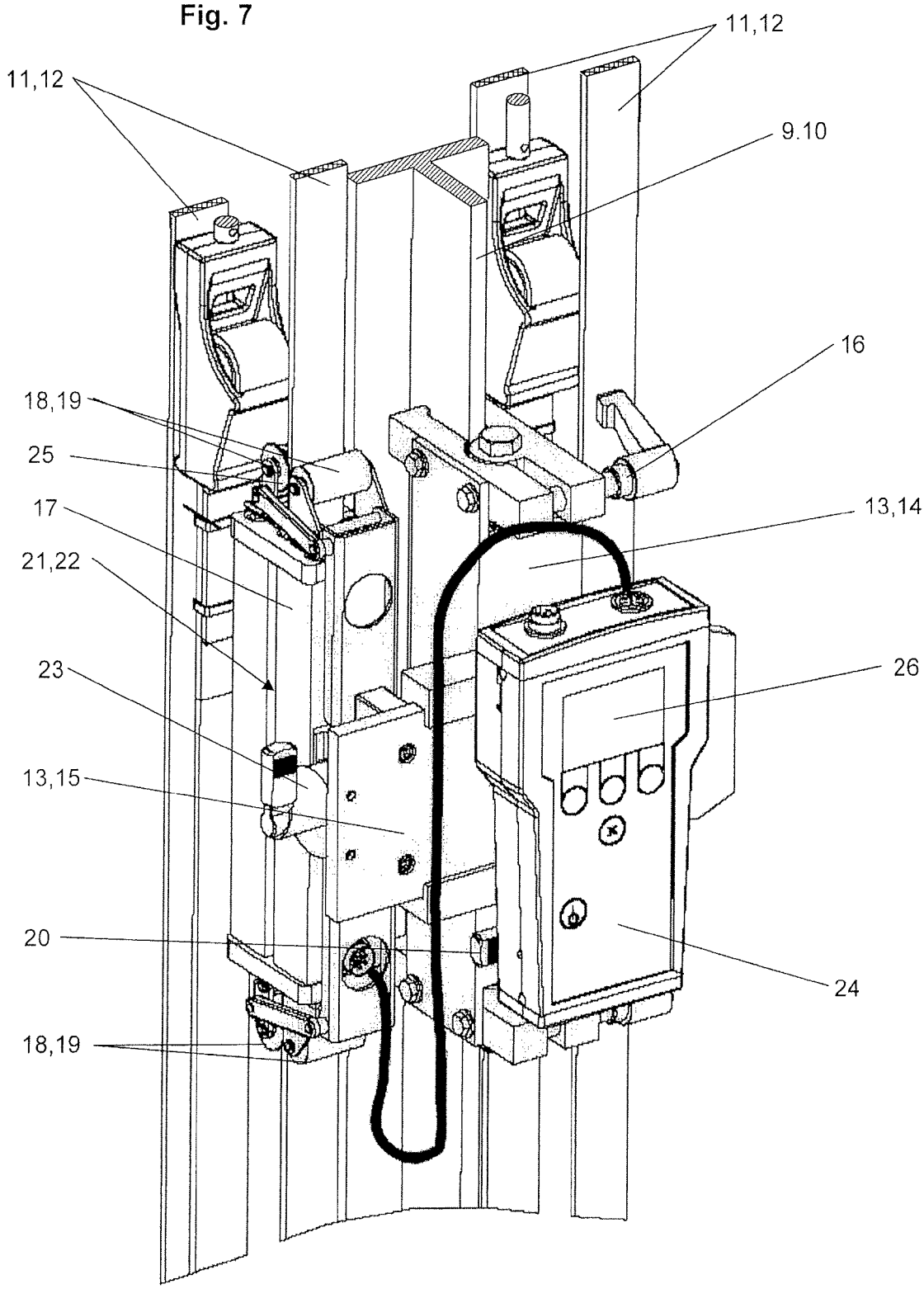
FIG. 7 is a detail view of the attached support means monitoring unit shown in FIG. 6 with attached evaluating unit.

FIG. 3 and FIG. 6 show an arrangement according to the present invention of a support means monitoring device 17. The illustrated example concerns the elevator installation 1 without an engine room, wherein the drive device is arranged in the shaft head 3 of the shaft 2, preferably in the region above a counterweight travel path. The elevator car 4 is guided by means of guide tracks 9 and the support means 11 are arranged in the vicinity of the guide tracks 9. The support means 11 are in this connection guided by the drive device 8 to the support rollers 6 arranged at the car side. The support means monitoring device 17 is, as illustrated in FIG. 6 and FIG. 7, fastened to the guide track 9 by means of a support 13. This is advantageous, since a spacing (L) from the drive device 8 can be selected in such a manner that possible electromagnetic fields—as are produced by an electrically operated motor—do not influence the support means monitoring device 17, positioning can be carried out very accurately, since the guide tracks 9 can be produced and aligned very precisely, and the location of the mounting can be reached in simple manner from the roof of the car 4.

This form of arrangement is particularly advantageous if at least two of the support means 11 are used and the support means 11 are arranged on the left and the right of a guide plane (ZZ'), which is formed by the guide tracks 9 of the car 4, preferably symmetrically with respect to this guide plane (ZZ'), as is apparent by way of example in FIG. 3*a*. However, arrangements of the support means 11 on only one side of the guide track 9 are also possible.

Figure 4:
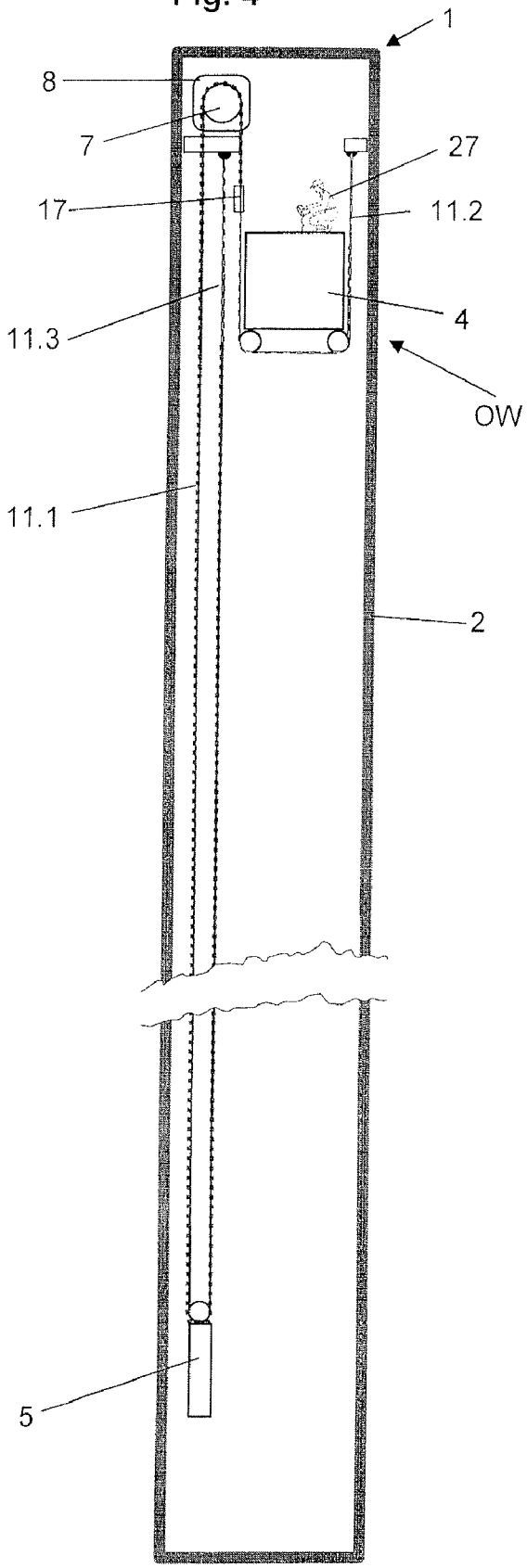
FIG. 4 is a schematic view of the start point of a check travel of an elevator installation.
Figure 5:
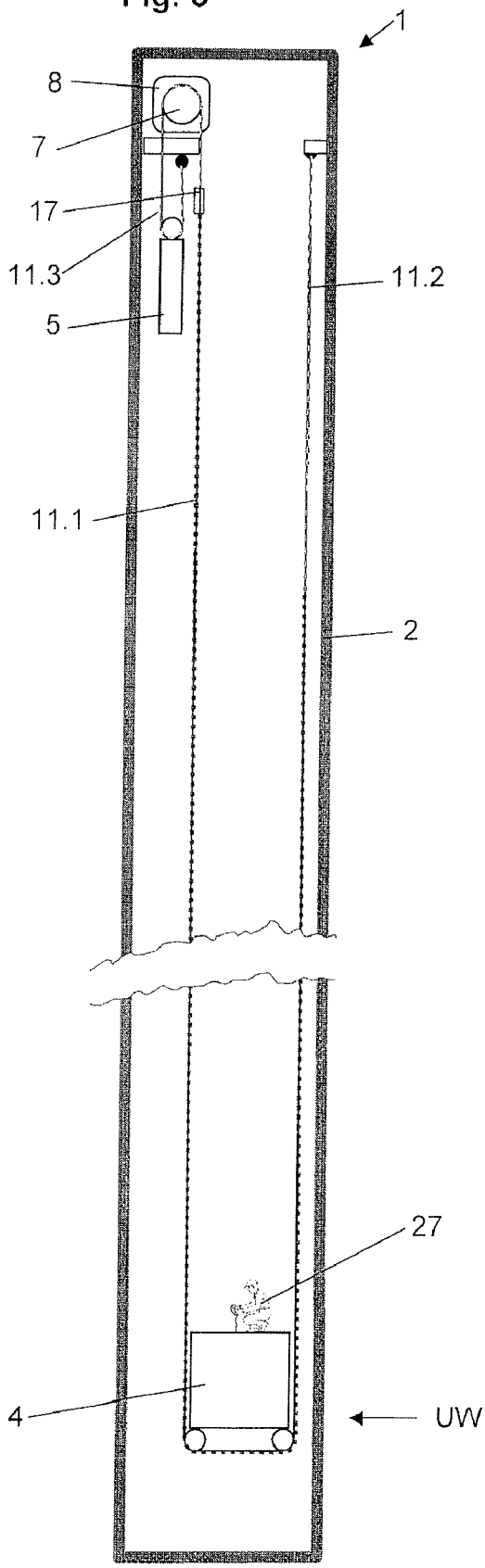
FIG. 5 is a schematic view of the end point of a check travel in an elevator installation.

Advantageously the support means 11, as illustrated in FIG. 3, is used at the same time as the drive means driven by the drive device 8, and the support means monitoring device 17 is mounted in the vicinity of this drive device 8. Mounting in the vicinity of the drive device 8 has the advantage that the most-loaded locations of the support means 11 (drive zone, heating) are necessarily detected. In this case a spacing (L) of 0.4 meters up to approximately 1.6 meters from the drive means monitoring device 17 to the drive device 8 has proved optimum, wherein a spacing (L) of approximately 0.7 meters can be termed ideal. An influence of disturbing fields of the drive device 8 is thereby negligible and at the same time a large length region of the support means 11 can be detected in one measuring or check travel. A check travel usually runs, as illustrated in FIGS. 4 and 5, from an uppermost maintenance position (OW), FIG. 4, to a lowermost maintenance position (UW), FIG. 5. The uppermost maintenance position (OW) is that position which can be traveled to by the elevator car 4 in an upward direction for the purpose of maintenance. This uppermost maintenance position (OW) can in the case of need be displaced downwardly if the attachment of the support means monitoring device obliges this. The lowermost maintenance position (UW) is that position which can be traveled to by the elevator car 4 in a downward direction for the purpose of maintenance. Obviously other check travel paths are possible, but the checkable region is then correspondingly restricted.

The support means monitoring device 17 is usually installed temporarily, i.e. merely for the purpose of the check, in the elevator installation 1. This is advantageous, since accordingly one support means monitoring device 17 can be used for monitoring several or many of the elevator installations 1. According to the present invention the support means monitoring device 17, as illustrated in FIG. 7, is equipped with guide devices 18 which ensure a precise introduction and a precise positioning or guidance of the support means 11 with respect to the support means monitoring device 17. The guide device 18 is advantageously arranged at the two ends, or at the inlet end region and/or outlet end region, of the support means monitoring device 17. The support means 11 is thus introduced in the correct position into the support means monitoring device 17 and it is thereby guided in an ideal measuring position over the entire length of the support means monitoring device 17. An exact measuring is thereby made possible and damage of the support means due to running into the same at an angle is precluded. An angled running in can result when the support means 11 is twisted or when a positional deviation exists between adjacent deflecting rollers.

The guide device 18 can comprise slide members, but preferably use is made of guide rollers 19 which guide the support means 11 along a scanning surface 21 of the support means monitoring device 17. The scanning surface 21 is constructed in accordance with the respectively employed checking method. It comprises activation elements such as electromagnets or ultrasound elements and also measuring sensors that record resulting measurement fields or measurement signals. The scanning surface 21 can entirely or partly enclose the support means 11. The guide device 18 is advantageously arranged directly at the support means monitoring device 17, but it can also be arranged at the support 13. The selected form of embodiment is oriented towards space and cost demands. An arrangement of the guide device 18 directly at the support means monitoring device 17, as realized in FIG. 7, is frequently advantageous, since the guide quality is improved. The scanning surface 21 of the support means monitoring device 17 is advantageously provided with an exchangeable protective coating 22 which protects the scanning surface 21 against damage, wherein this protective coating 22 can be a plastic material protective film or a plastic material covering. Not only the scanning surface 21, but also the support means 11 are thereby protected against damage and the protective coating 22 can be renewed in simple manner in the case of contamination of damage.

Figure 8:
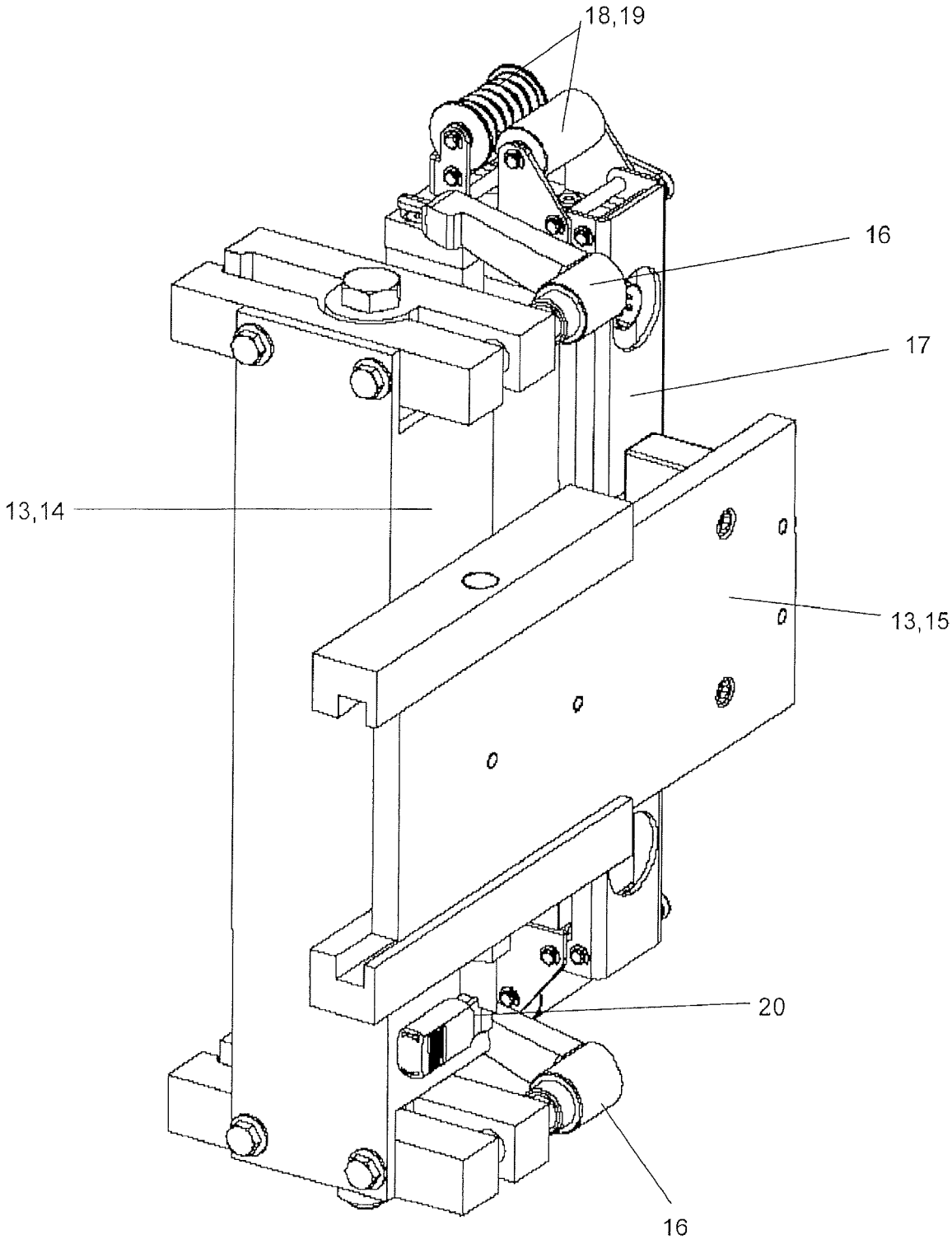
FIG. 8 is a detail view of the support, not installed and without the evaluating unit.

Advantageously the guide track 9 is a guide rail 10, which preferably has a T-shaped form as apparent in FIG. 7, and the support 13, which is used for fastening the support means monitoring device 17 to the guide rail 10, comprises a first support part 14, which is connected by means of a quick-action connection 16—for example a clamping connection—with the guide rail 10, and a second support part 15 which is arranged to be displaceable and/or settable relative to the first support part 14, the support means monitoring device 17 being fastened to this second support part 15. In FIG. 8 the support 13 is illustrated not in an installed state, but with the support means monitoring device 17 pre-mounted. The second support part 15 is fastened by a quick-action clamp 20 to the first support part 14. A rapid, accurate and simple alignment of the support means monitoring device 17 with respect to the support means 11 to be checked is thereby possible.

The second support part 15 is constructed in such a manner that without displacement of the first support part 14 an exchange of the support means monitoring device 17 from monitoring a left-hand support means (FIG. 7) to monitoring a right-hand support means (FIG. 8) is possible. For this purpose there is provided a further quick-action connection 23 which enables a rapid detaching and fastening of the support means monitoring device 17 from and to the second support part 15. The displaceability is thus designed in such a manner that there can be adjustment to the anticipated multiplicity of support means arrangements of a specific elevator kind. If, for example, several support means 11 are arranged on one side of the guide track 9 the displaceability is designed in such a manner that the support means monitoring device 17 can be pushed from a first to the last support means 11. In a special embodiment the support 13 can be constructed in such a manner that it remains or is installed in a stationary position in the installation. In this construction it is mounted in such a manner that it does not disturb normal operation of the elevator installation. When a check is required, the support means monitoring unit 17 can be mounted rapidly and without further aligning work. This is particularly efficient, but requires a greater outlay of material, since the support 13 has to be provided for each individual elevator installation. Obviously also combinations of these constructions are possible. For example, merely the first support part 14 can be fixedly installed and the second support part 15 is mounted by means of the quick-action clamp 20 in the case of checking.

The support means 11 is, for example, a belt-like support means 12 and load-bearing parts of the support means are of metallic, preferably strand-shaped, construction. In the case of the support means 11 of that kind the support means monitoring device 17 preferably contains magneto-inductive measuring devices. However, ultrasound apparatus or optical measuring apparatus as also possible.

An evaluation or interpretation of the measurement result can in principle be undertaken manually. In this case the presence of a trained checker is required, who carries out this evaluation.

Figure 9:
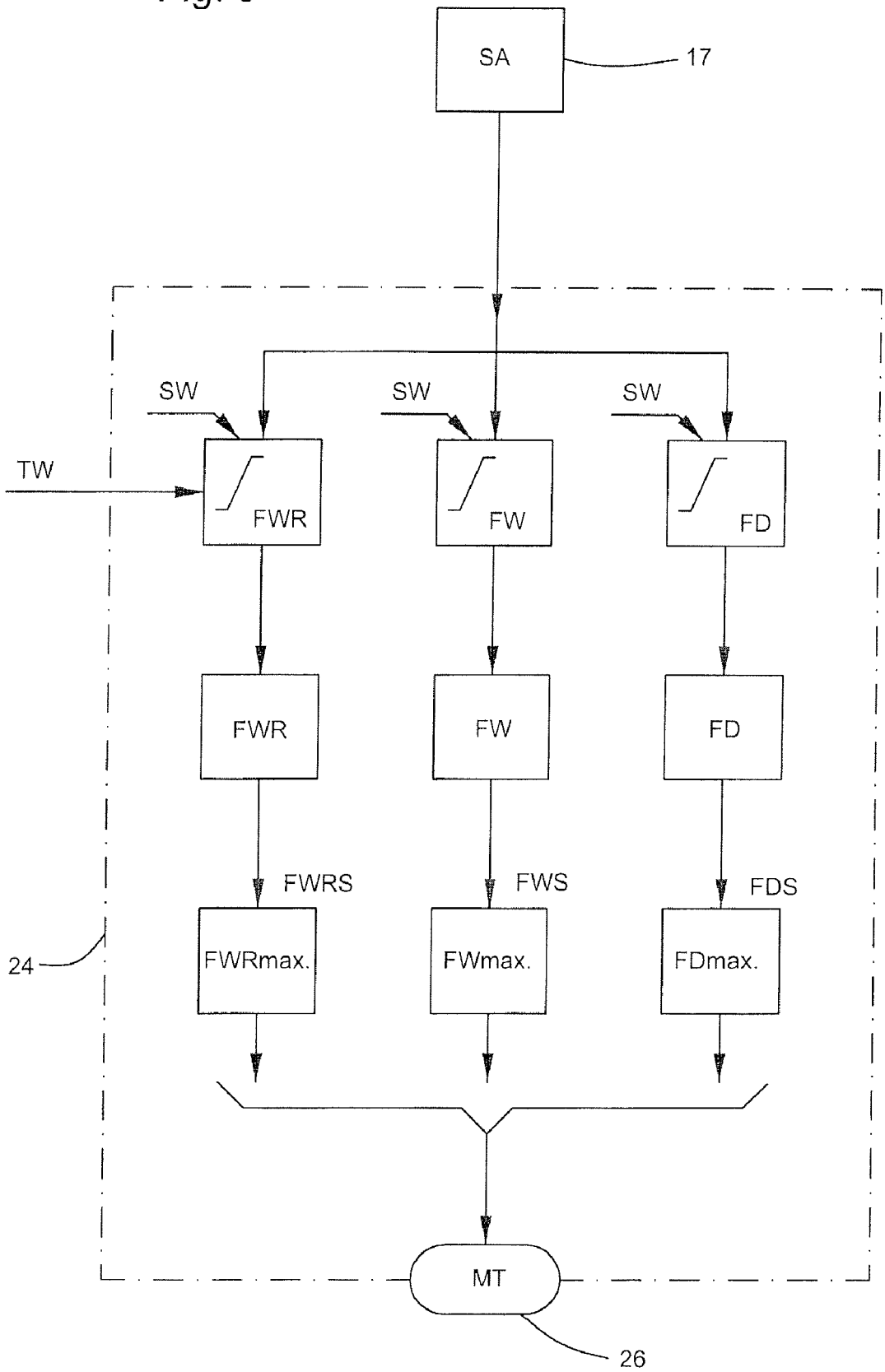
FIG. 9 is a block diagram of the evaluating unit.

In a proposed embodiment of the present invention, however, the support means monitoring device 17 is connected with an evaluating unit 24. Such an evaluating unit 24 is shown in FIG. 7 in an attached state. The support means monitoring device 17 in this case generates a signal (SA) which corresponds with changes in the structure of the supporting cross-section of the load-bearing part of the support means 11 and the evaluating unit 24 evaluates this signal during performance of the check. The evaluating unit 24 ascertains, as schematically illustrated in FIG. 9, a fault value (FD) and/or a wear value (FW) and/or a resulting wear value (FWR) and the evaluating unit 24 shows a maximum value of the fault value ($FD_{max}$) and/or of the wear value ($FW_{max}$) and/or the resulting wear value ($FWR_{max}$) and/or an overall state (MT) of the support means. An evaluating unit of that kind enables evaluation independent of persons. The evaluation is carried out in accordance with predetermined criteria; i.e. a risk of erroneous interpretations is virtually excluded. An evaluation of that kind is very reliable. Depending on the respective definition a check can be established with respect to wear or with respect to fault or with respect to an overall state of the support means 11. By wear there is understood in this connection a continuous change such as abrasion or corrosion or degradation and by fault there is understood individual events such as, for example, fracture of a load-bearing element or a part thereof. The overall state or the resulting wear value weights the state of the cable usually over a defined time segment (TW).

Figure 10:
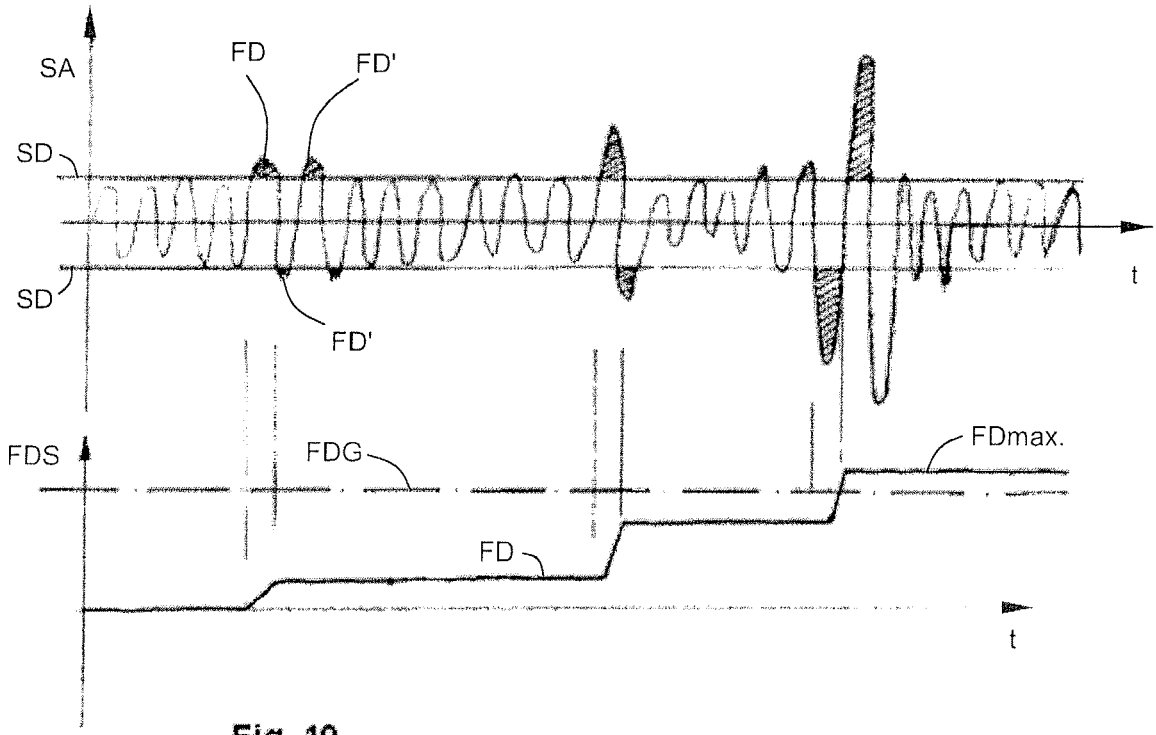
FIG. 10 is a plot, by way of an example, of a measuring/evaluating sequence of a fault assessment according to the present invention.

In a realized version the evaluating unit 24 ascertains the fault value (FD) in that there is a search for local absolute values of the signal (SA). FIG. 10 represents an example of an evaluation of that kind with the signal value plotted against time. The signal (SA) measured by the support means monitoring device 17 is recorded in dependence on a measuring time (t). A fault threshold value (SD) is defined, from which all signals (SA) greater than the fault threshold value (SD) are summed to form the fault value (FD). The summation is carried out until the signal (SA) again falls below the fault threshold value (SD). A global scaling factor and a speed compensation factor (KF) are then additionally multiplied by this "integral formation". The factors are experimentally ascertained on one occasion by way of model support means. During a measurement process, the largest ascertained fault value ($FD_{max}$) is always then stored in the fault value memory (FDS). A plot, by way of example, of the fault value (FD) stored in the fault value memory (FDS) with respect to the signal (SA) is illustrated in FIG. 10. Of the measurement values, only the amount is used. Thus the travel direction or polarity does not play a role in the analysis.

Figure 11:
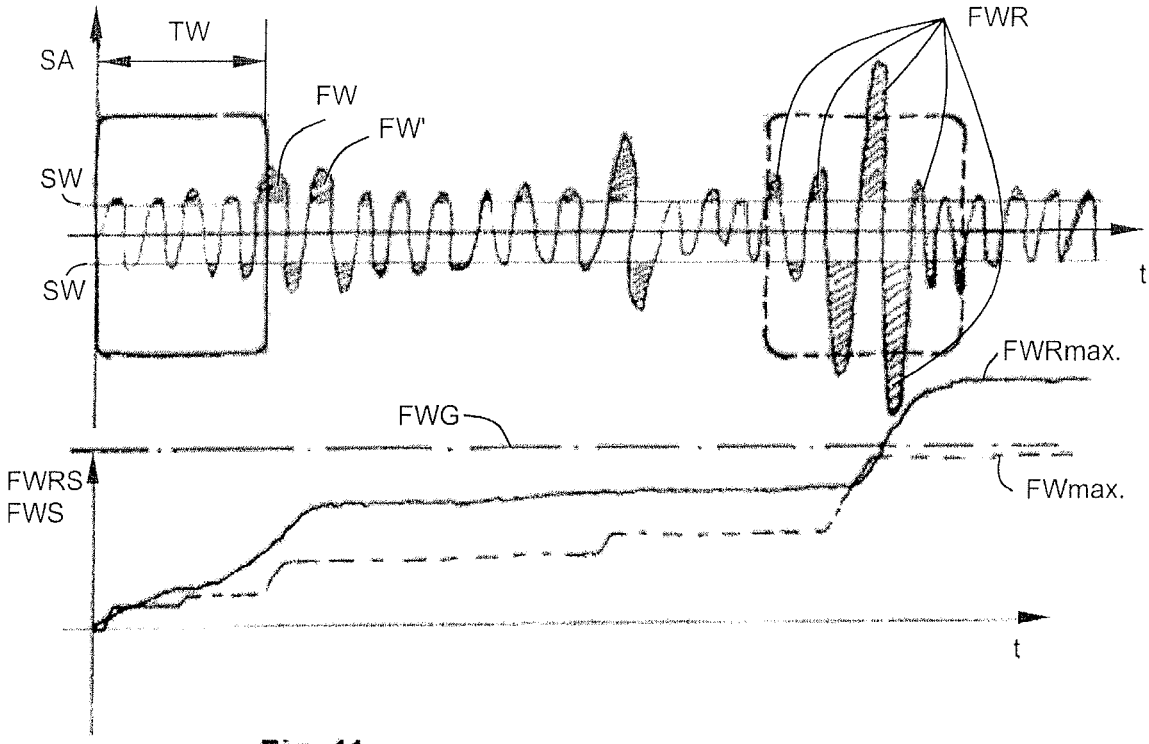
FIG. 11 is a plot, by way of example, of a measuring/evaluating sequence of a wear assessment according to the present invention.

The wear value (FW) can also be ascertained in the same mode and manner. An example of such an evaluation is illustrated in FIG. 11 in graphical form. The illustration is analogous to the above-explained fault value evaluation. The evaluation unit ascertains the wear value (FW), in that it sums the absolute value of the signal (SA), beginning at a point in time at which the absolute value of the signal (SA) exceeds a wear threshold value (SW), to form the wear value (FW) until the absolute value of the signal (SA) falls below the wear threshold value (SW), multiplies this wear value (FW) by a wear correction factor (KW) and files it in a wear value memory (FWS). The evaluating unit again sums, at every further point in time at which the absolute value of the signal (SA) again exceeds the wear threshold value (SW), to form a further wear value (FW') until the absolute value of the signal (SA) again falls below the threshold wear value (SW). This further wear value (FW') is multiplied by the wear correction factor (KW) and filed in the wear value memory (FWS) when the wear value (FW') ascertained in that manner is greater than the current wear value (FW) filed in the wear value memory (FWS).

These forms of embodiment make possible a traceable statement with respect to the state of a support means 11 at the elevator installation 1 and the result is free of interpretations.

The wear and/or fault correction factor (KF, KW) is preferably scaled in such a manner that a limit value of below 1,000 is indicated as acceptable and a limit value of 1,000 and more is indicated as inadequate. The wear and/or fault correction factor (KF, KW) in that case takes into consideration a check speed and a general scaling value. This limit value is denoted in FIGS. 10 and 11 as a fault limit value or a permissible fault value (FDG) or a wear limit value or a permissible wear value (FWG).

In a further embodiment a resulting wear value (FWR) is ascertained. In this connection the wear values (FW') are detected during a measurement in a continuous inspection time period (TW) in correspondence with a support means length of, for example, 500 millimeters. In the case of this embodiment as well as the largest resulting wear sum values (FWR) ascertained over the inspection time period (TW) are stored in a resulting wear value memory (FWRS) and used for assessment of the state of the support means. A correction with the correction factor (KW) is carried out as already illustrated by way of the example of the wear value (FW). The inspection time period (TW) is, in a realized example, detected by means of a time transmitter and an input of the test travel speed. Alternatively, it is detected by means of a time transmitter and a speed or travel measuring device 25 (FIG. 7). This speed or travel measuring device 25 can, for example, be integrated in the guide device 18.

The evaluating unit 24 usually has a display 26 which, for example, indicates an overall state (MT) of the support means as being in order (MTO) when:

- the largest fault value ($FD_{max}$) filed in the fault value memory (FDS) is smaller than a permissible fault value (FDG); and/or
- the largest wear value ($FW_{max}$) filed in the wear value memory (FWS) is smaller than a permissible wear value (FWG); and/or
- the largest resulting wear value ($FWR_{max}$) filed in the resulting wear value memory (FWRS) is smaller than a permissible wear value (FWG), and the evaluating unit indicates the overall state of the support means (NT) as deficient (MTR) when:

- the largest fault value ($FD_{max}$) filed in the fault value memory (FDS) is greater than the permissible fault value (FDG); and/or
- the largest wear value ($FW_{max}$) filed in the wear value memory (FWS) is greater than the permissible wear value (FWG); and/or
- the largest resulting wear value ($FWR_{max}$) filed in the resulting wear value memory (FWRS) is greater than a permissible wear value (FWG).

A simple decision for necessary replacement or further operation of support means 11 is thus possible.

Obviously, in a further embodiment the measurement results can, in the case of need, also be printed out by the evaluating unit (24), stored or transmitted to a remote diagnostic station. This enables, in particular, a long-term prognosis, since several measurements spaced apart in time can be compared with one another and thus, for example, a prognosis with respect to the anticipated further service life of the support means 11 can be made. In addition, with use of these measurement results a statement can be made about the location of the effectively greatest wear or fault.

A check sequence according to the invention preferably comprises the following steps:

- visual checking of the support means 11;
- parking the elevator car 4 in the vicinity of the uppermost maintenance position (OW);
- arranging the support means monitoring device 17 by means of the support 13 at the guide track 9 at the spacing (L) from the drive;
- alignment of the support means monitoring device 17 with respect to a first one of the support means 11;
- optional input of the check travel speed into the evaluating unit 24 of the support means monitoring device 17;
- starting the check recording;
- manual (inspection control) or controlled (elevator regulation) movement over the entire path, which can be traveled, of the elevator shaft 2 in a downward direction to the lowermost maintenance position (UW);
- concluding the check recording;
- evaluating the measurement and establishing the check result of the first support means 11;
- repeating, if required, the check for the same support means 11 or for further one of the support means 11.

A best degree of reliability is achieved by the preferred combination of visual and apparatus-assisted checking, since not only unusual forms of damage, such as overheating of a support means casing or external harm, but also internal damage, for example as a consequence of corrosion or fatigue, are ascertained. The check can be carried out by one service engineer 27 alone. This is particularly efficient.

The visual check in that case preferably also includes:

- checking of fastening points of the support means 11;
- checking the correct alignment of the support means 11 with respect to the rollers 6 connected with the support means 11;
- checking that the support belt 11, 12 does not have any unintended contact with surrounding parts; and
- checking the correct mounting of protective devices such as protective brackets, guide aids, etc.

With knowledge of the present invention the elevator expert can change, as desired, the set forms and arrangements. For example, the explained inspection time period (TW) can be changed in accordance with need or the illustrated support means monitoring unit 17 can also be used at other fastening points, such as, for example, on the car 4. In addition, use for elevator installations with 1:1 suspension or for elevator installations with multiple suspension is possible.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In an elevator installation with an elevator car and a counterweight connected by a belt support means and which are movable in a vertical shaft in opposite sense along guide tracks, a support means monitoring assembly for monitoring the state of the support means, comprising:

- a support means monitoring device having a scanning surface;
- a support fastened on one of the guide tracks and mounting said support means monitoring device; and
- a guide device guiding the belt support means along said scanning surface during running of the belt support means.

2. The elevator installation according to claim 1 wherein said guide device includes at least one roller for engaging a surface of the belt support means.

3. The elevator installation according to claim 1 wherein said guide device is arranged at opposite ends of said support means monitoring device and is attached to said support means monitoring device.

4. The elevator installation according to claim 1 wherein said scanning surface is provided with an exchangeable protective coating protecting said scanning surface against damage.

5. The elevator installation according to claim 4 wherein said protective coating is formed of a plastic material protective film or a plastic material covering.

6. The elevator installation according to claim 1 wherein said support means monitoring device is mounted at a predetermined spacing from a drive device driving the belt support means for scanning a substantial length of the belt support means during a check travel.

7. The elevator installation according to claim 6 wherein said predetermined spacing is in a range of 0.4 meters to 1.6 meters from the drive device.

8. The elevator installation according to claim 1 wherein said support means monitoring device includes a scanning device integrated in said scanning surface and an evaluating unit connected with said scanning device, said support means monitoring device generates a signal corresponding with a change in a structure of a supporting cross-section of a load-bearing part of the belt support means and said evaluating unit evaluates said signal during performance of a check travel, and said evaluating unit ascertains at least one of a fault value (FD), a wear value (FW) and a resulting wear value (FWR), said evaluating unit indicates at least one of a maximum value of the fault value ($FD_{max}$), of the wear value ($FW_{max}$), the resulting wear value ($FWR_{max}$) and an overall state (MT) of the belt support means, and said evaluating unit indicates the overall state (MT) of the belt support means as being in order (MTO) when the maximum value of the fault value ($FD_{max}$) is less than a permissible fault value (FDG), and/or the maximum value of the wear value ($FW_{max}$) is less than a permissible wear value (FWG), and/or the maximum value of the resulting wear value ($FWR_{max}$) is less than a permissible wear value (FWG)

and said evaluating unit indicates the overall state (MT) of the support means (11) as deficient (MTR) when the maximum value of the fault value ($FD_{max}$) is greater than a permissible fault value (FDG), and/or the maximum value of the wear value ($FW_{max}$) is greater than a permissible wear value (FWG), and/or the maximum value of the resulting wear value ($FWR_{max}$) is greater than a permissible wear value (FWG).

9. The elevator installation according to claim 1 wherein said support means monitoring device includes a scanning device integrated in said scanning surface and an evaluating unit connected with said scanning device for determining a resulting wear value ($FWR_{max}$) in consideration of an inspection time period (TW) corresponding with a measurement distance of approximately 500 millimeters.

10. The elevator installation according to claim 1 wherein said support means monitoring device is connected with an output apparatus which creates at least one of a measurement record and a state record of a performed check of the belt support means.

11. A method of checking a belt support means in an elevator installation comprising the steps of:

a) arranging a support means monitoring device with a support at a guide track of the elevator installation at a predetermined spacing from a drive of the elevator installation;

b) aligning the support means monitoring device with a first belt support means;

c) optionally carrying out input of a check travel speed into an evaluating unit of the support means monitoring device;

d) starting a check recording;

e) controlling travel of the belt support means over an entire path of an elevator shaft of the elevator installation while measuring the first belt support means with the support means monitoring device;

f) concluding the check recording;

g) evaluating measurements obtained from the support means monitoring device and establishing a check result of the first belt support means; and h) repeating, if needed, steps b) through g) for further belt support means of the elevator installation.

12. The method according to claim 11 wherein initially a visual check of the belt support means is carried out, wherein the visual check comprises at least one of the following steps:

visual checking of a state of the belt support means and fastening points of the belt support means;

checking for a correct alignment of the belt support means with respect to rollers connected with the belt support means;

checking that the belt support means does not have unintended contact with surrounding parts;

checking correct mounting of protective devices such as protective brackets and guide aids; and visually checking the belt support means for damage such as fractures, impacts or visible wear.

13. The elevator installation according to claim 1 wherein said support means monitoring device transmits at least one of measurement data and state data of a performed check to a central control station.

14. In an elevator installation with an elevator car and a counterweight connected by a belt support means and which are movable in a vertical shaft in opposite sense along guide tracks, a support means monitoring assembly for monitoring the state of the support means, comprising:

a support means monitoring device having a scanning surface and including a scanning device integrated in said scanning surface and an evaluating unit connected with said scanning device, said support means monitoring device generating a signal corresponding with a change in a structure of a supporting cross-section of a load-bearing part of the belt support means and said evaluating unit evaluating said signal during performance of the check;

a support fastened on one of the guide tracks and mounting said support means monitoring device; and a guide device guiding the belt support means along said scanning surface during running of the belt support means, wherein said evaluating unit ascertains at least one of a fault value (FD), a wear value (FW) and a resulting wear value (FWR), said evaluating unit indicates at least one of a maximum value of the fault value ($FD_{max}$), of the wear value ($FW_{max}$), the resulting wear value ($FWR_{max}$) and an overall state (MT) of the belt support means, and said evaluating unit indicates the overall state (MT) of the belt support means as being in order (MTO) when the maximum value of the fault value ($FD_{max}$) is less than a permissible fault value (FDG), and/or the maximum value of the wear value ($FD_{max}$) is less than a permissible wear value (FWG), and/or the maximum value of the resulting wear value ($FWR_{max}$) is less than a permissible wear value (FWG)

and said evaluating unit indicates the overall state (MT) of the support means (11) as deficient (MTR) when the maximum value of the fault value ($FD_{max}$) is greater than a permissible fault value (FDG), and/or the maximum value of the wear value ($FW_{max}$) is greater than a permissible wear value (FWG), and/or the maximum value of the resulting wear value ($FWR_{max}$) is greater than a permissible wear value (FWG).

* * * * *